US012538977B1

(12) United States Patent
Hawes

(10) Patent No.: US 12,538,977 B1
(45) Date of Patent: Feb. 3, 2026

(54) MULTI-ORIENTATION ATTACHMENT SYSTEM

(71) Applicant: AXL LLC, Wylie, TX (US)

(72) Inventor: Matthew Hawes, Pinehurst, NC (US)

(73) Assignee: AXL LLC, Wylie, TX (US)

( * ) Notice: Subject to any disclaimer, the term of this patent is extended or adjusted under 35 U.S.C. 154(b) by 247 days.

(21) Appl. No.: 18/379,295

(22) Filed: Oct. 12, 2023

Related U.S. Application Data

(60) Provisional application No. 63/415,513, filed on Oct. 12, 2022.

(51) Int. Cl.
*A45F 5/02* (2006.01)

(52) U.S. Cl.
CPC ..... *A45F 5/021* (2013.01)

(58) Field of Classification Search
CPC ..... Y10S 24/31; Y10T 24/318; A45F 5/021; A45F 5/02; A45F 3/08
USPC ..... 24/31; 224/672
See application file for complete search history.

(56) References Cited

U.S. PATENT DOCUMENTS 1,144,792 A * 6/1915 Romberger ..... G09F 3/037 292/319
2,426,975 A * 9/1947 Roach ..... D03C 9/0683 403/396
4,233,715 A * 11/1980 McDermott ..... G09F 3/005 40/640
5,497,818 A * 3/1996 Marcarelli ..... A45C 13/185 224/675
6,349,904 B1 2/2002 Polad
6,823,566 B2 11/2004 Coffey
10,130,162 B2 11/2018 Tang
2016/0040958 A1 2/2016 Alcantra et al.

* cited by examiner

*Primary Examiner* — Adam J Waggenspack
(74) *Attorney, Agent, or Firm* — Asgaard Patent Services, LLC; F. Wayne Thompson, Jr.

(57) ABSTRACT

Disclosed is an attachment system used to secure an article, such as a pouch, to a belt. An example attachment system includes an attachment strap and a fastener. The attachment strap includes a top portion, a bottom portion, and a middle portion, each of which include an opening. The fastener includes a threaded post and a screw. The attachment strap is configured to fold so that the opening in the bottom portion and the opening in the top portion are both aligned with the opening in the middle portion. The fastener is configured to extend through the aligned openings of the attachment strap and removably fasten both the bottom portion and top portion to the middle portion to form a closed loop. The attachment system may also include a mounting plate that is used in conjunction with the attachment strap to secure an article to a belt or other wearable item.

6 Claims, 10 Drawing Sheets

MULTI-ORIENTATION ATTACHMENT SYSTEM

CROSS-REFERENCE TO RELATED APPLICATION(S)

This application claims the benefit of U.S. Provisional Application Ser. No. 63/415,513, filed on Oct. 12, 2022, the entirety of which is incorporated herein by reference.

TECHNICAL FIELD

This disclosure relates to a multi-orientation attachment system. In particular, the present disclosure is directed to an attachment strap used to secure an article to a belt, or other suitably configured interface. Also disclosed is a mounting plate configured to facilitate mounting an article equipped therewith to a belt, or other suitably configured interface, in multiple orientations.

BACKGROUND

Gear items, such as tactical, camping, and hiking gear, are essential for professionals and outdoor enthusiasts alike. These gear items, ranging from ammunition magazines and grenades to flashlights and personal electronics, are typically carried in specially designed enclosures, such as pouches or bags, for storage and protection. Users rely on gear straps to attach these enclosures to various wearable items like belts, tactical vests, plate carriers, packs, and the like.

Attachment straps designed to secure gear carrying enclosures to wearable items are well known in the art. Typically, these straps consist of loops that can be securely fastened and released, allowing users to attach gear items or their enclosures to a standardized attachment system, such as the Pouch Attachment Ladder System (PALS) arrangement. However, these straps have notable shortcomings. Most notably, they do not rigidly affix the gear carrying enclosures in position. This permits the gear carrying enclosures to shift relative to the intended point of attachment, thereby compromising a user's ability to rapidly access a desired gear item. Another shortcoming is the inability of known strap designs to closely affix the gear carrying enclosure to the point of attachment. This creates unnecessary offset which increases the possibility of damage from collision with surrounding objects.

Accordingly, needs exist for the multi-orientation attachment system disclosed herein. It is to the provision of a multi-orientation attachment system configured to address these needs, and others, that the present invention is primarily directed.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is an attachment system used to secure an article, such as a pouch, to a belt or other wearable item.

An example attachment system comprises an attachment strap and a fastener. The attachment strap includes a top portion, a bottom portion, and a middle portion, each of which include an opening. The fastener includes a threaded post and a screw. The attachment strap is configured to fold so that the opening in the bottom portion and the opening in the top portion are both aligned with the opening in the middle portion. The fastener is configured to extend through the aligned openings of the attachment strap and removably fasten both the bottom portion and the top portion to the middle portion to form a closed loop.

A method of forming the attachment strap into a closed loop is also provided.

Another example attachment system comprises an attachment strap, a fastener, and a mounting plate securable to a side of an article, such as a pouch. The attachment strap includes a top portion, a bottom portion, and a middle portion, each of which includes an opening. The mounting plate comprises a first array of openings, a second array of openings, and a third array of openings. The attachment strap is configured to fold so that the opening in the bottom portion and the opening in the top portion are both aligned with the opening in the middle portion. The fastener is configured to extend through the aligned openings of the attachment strap and removably fasten both the bottom portion and the top portion to the middle portion to form a closed loop. The mounting plate is configured to be used in conjunction with the attachment strap to secure the article to a belt in at least one orientation. The first array of openings, the second array of openings, and the third array of openings are positioned to facilitate attaching the mounting plate, and thereby the article, in more than one orientation on the belt.

A method of securing the article to the belt using the attachment strap is also provided.

BRIEF DESCRIPTION OF THE DRAWINGS

Like reference numerals refer to corresponding parts throughout the several views of the drawings.

DETAILED DESCRIPTION

Figure 1:
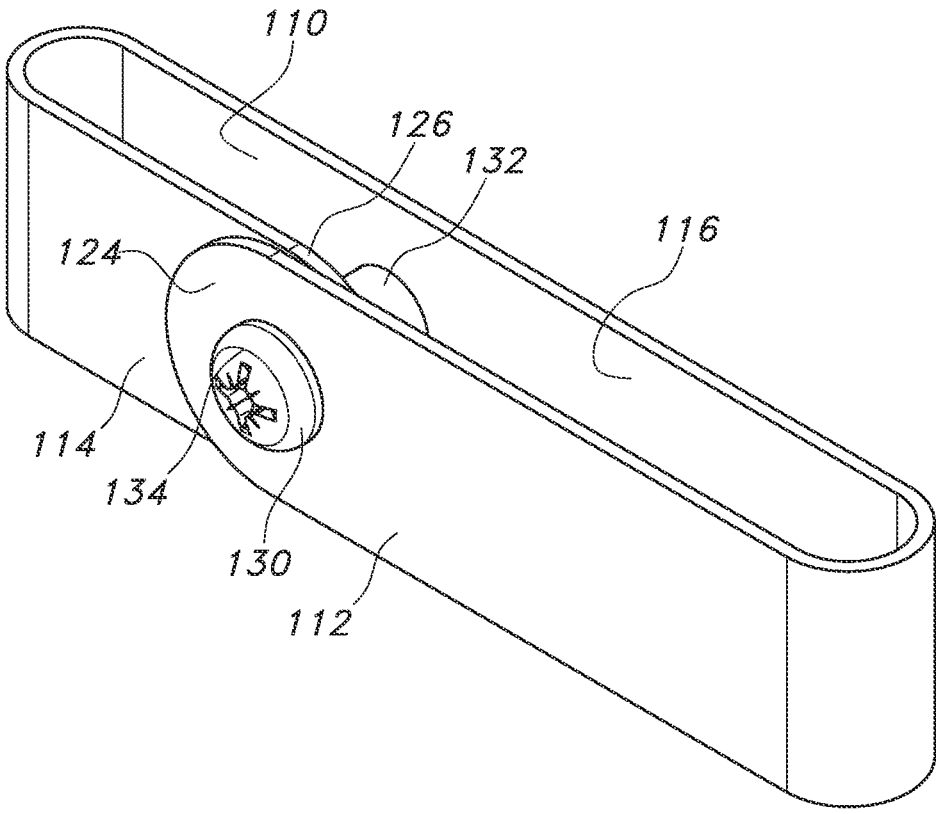
FIG. 1 is an isometric view of an attachment strap according to the principles of the present disclosure formed into a closed loop.
Figure 2:
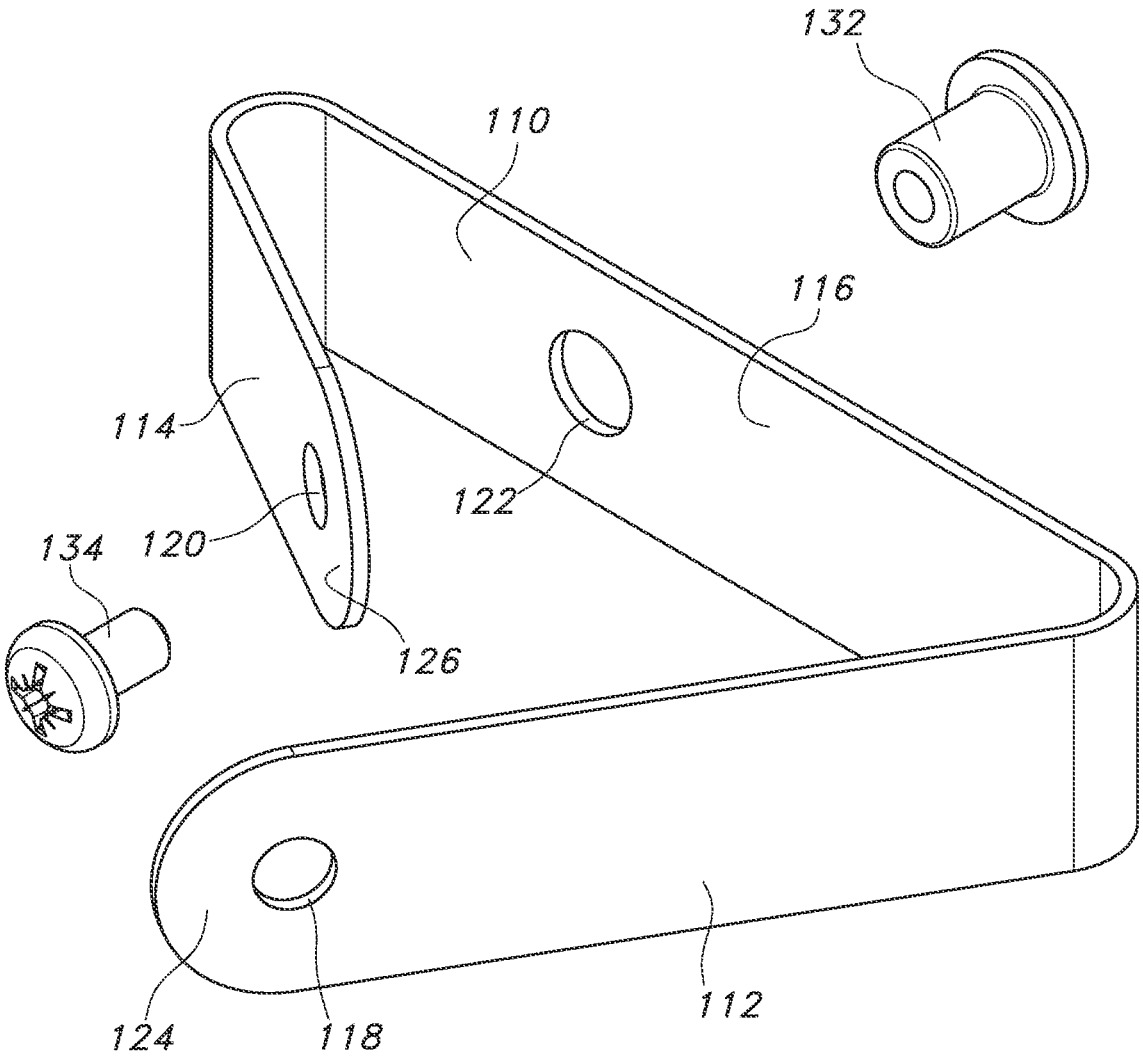
FIG. 2 is an exploded isometric view of the attachment strap shown in FIG. 1.
Figure 3:
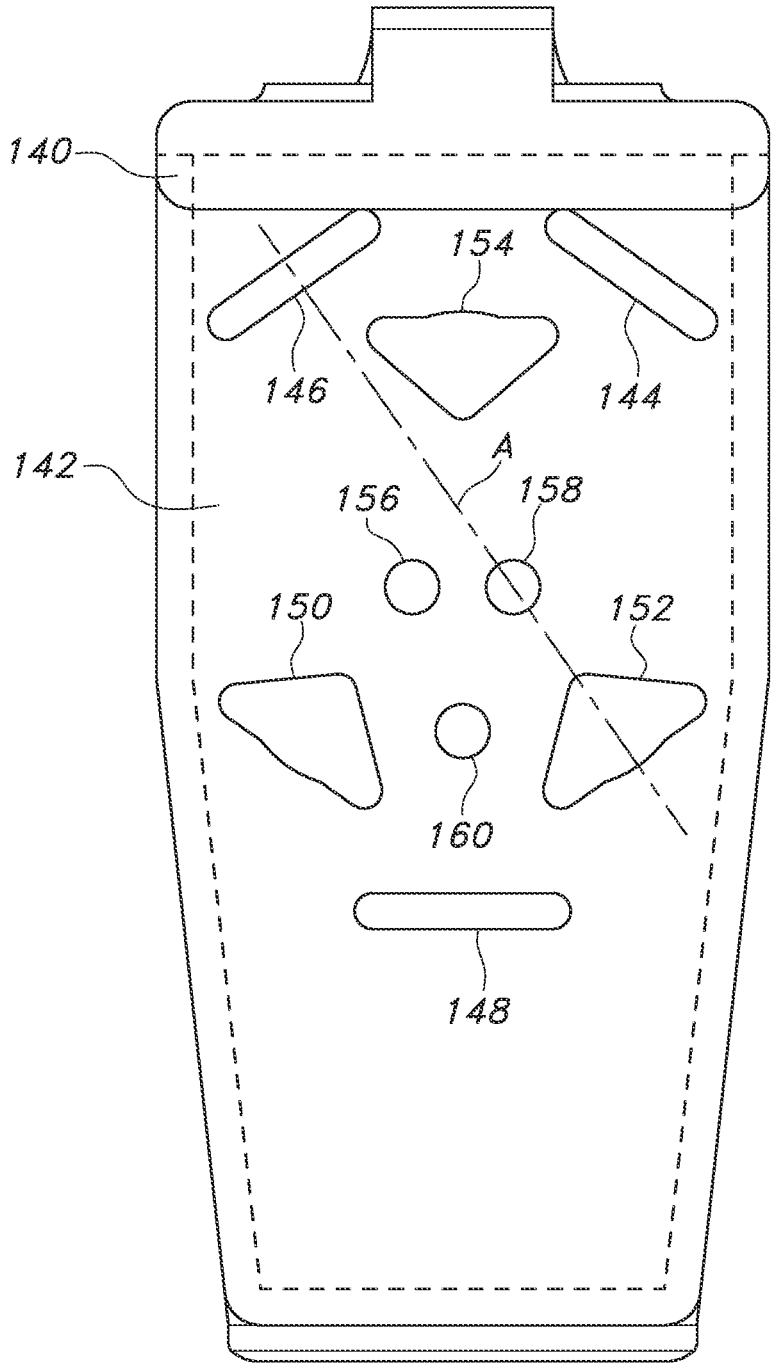
FIG. 3 is a rear side elevational view of an accessory pouch equipped with a mounting plate according to the principles of the present disclosure.
Figure 4:
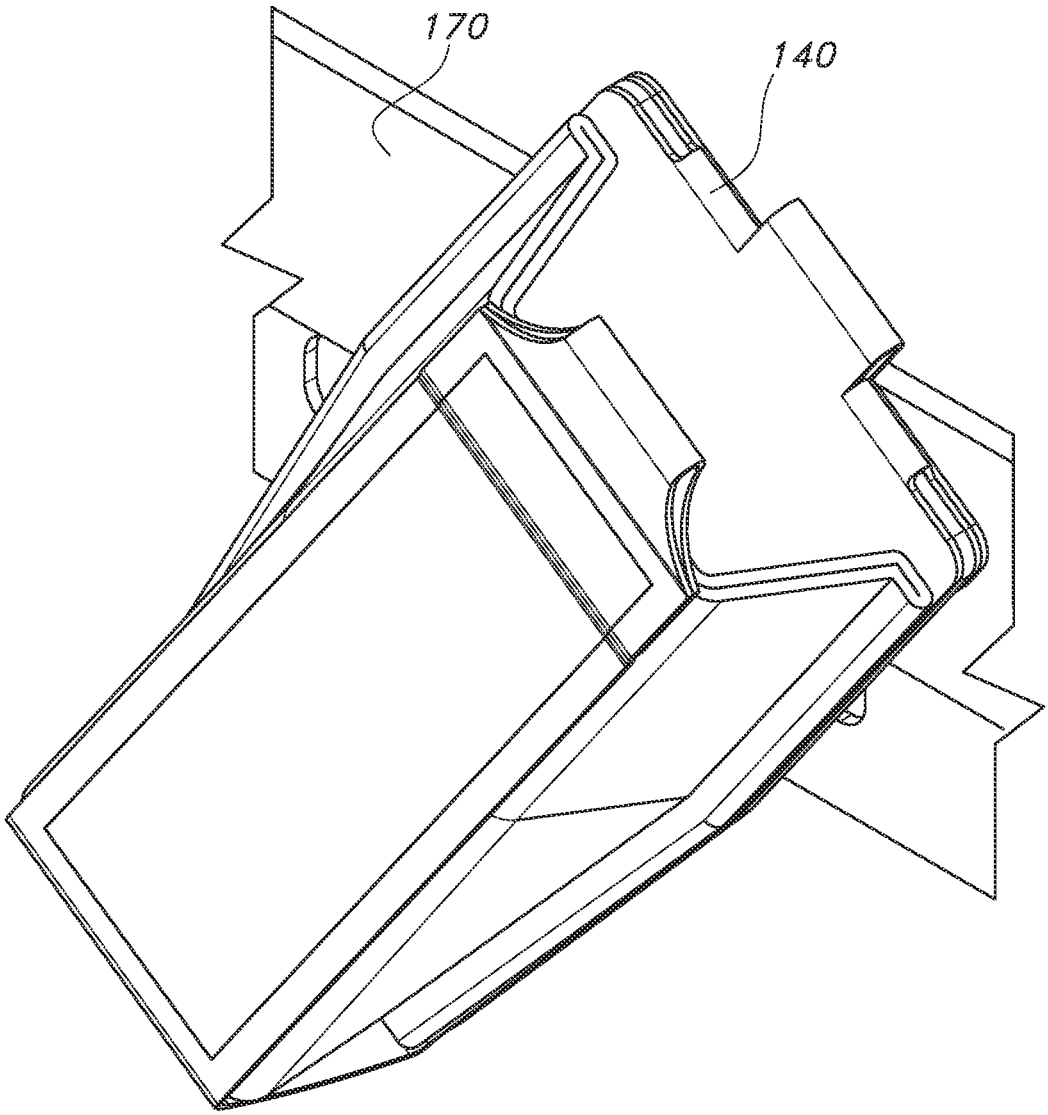
FIGS. 4 and 5 are isometric views of the accessory pouch shown in FIG. 3 attached to a belt using the attachment strap shown in FIG. 1.
Figure 5:
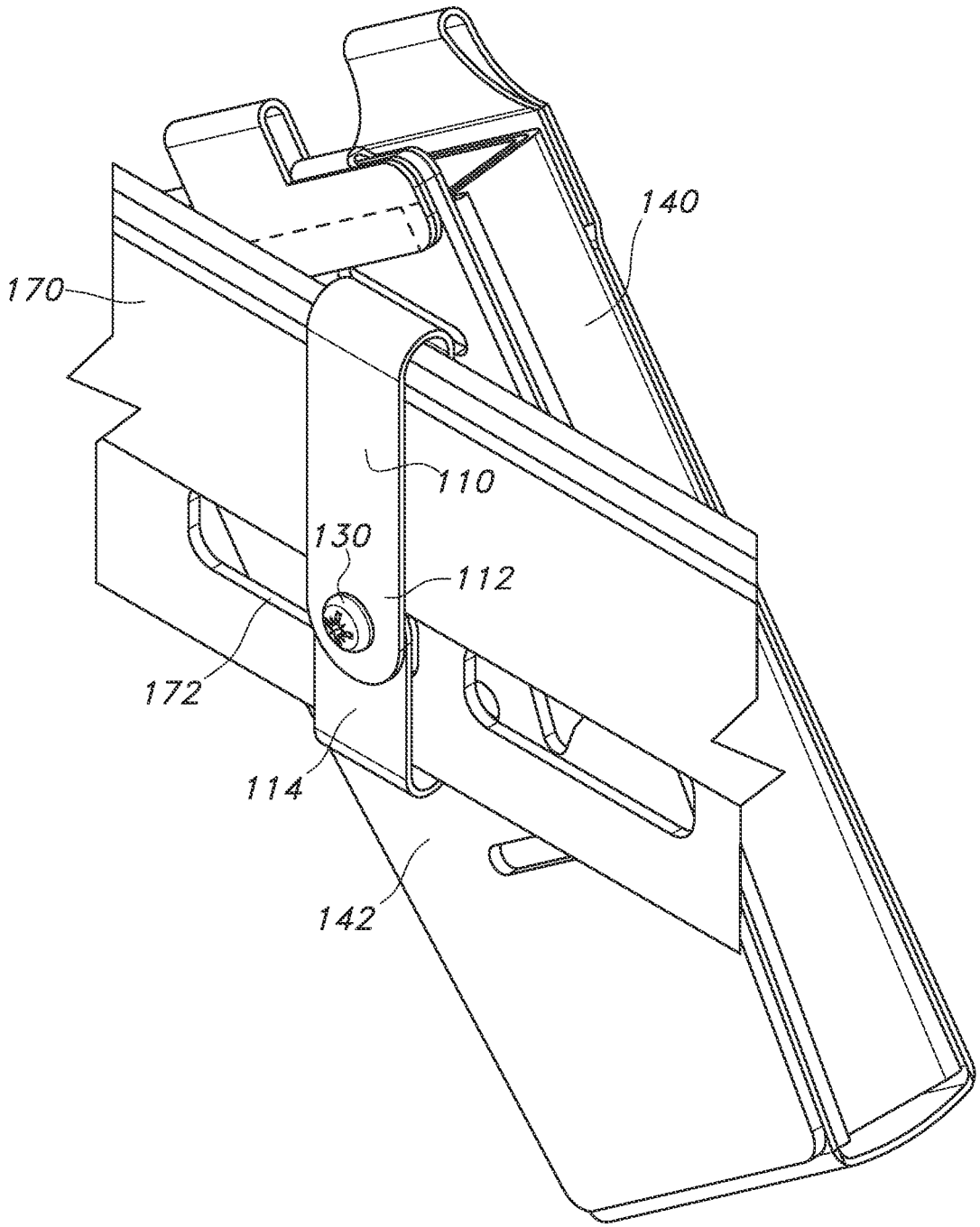

FIGS. 1 and 2 illustrate an attachment strap 110 according to the principles of the present disclosure. FIG. 3 illustrates an example accessory pouch 140 with a mounting plate 142 according to the principles of the present disclosure. FIGS. 4 and 5 illustrate the multi-orientation attachment system, comprising the attachment strap 110 and the mounting plate 142, being used to retain and secure the example accessory pouch 140 to a belt 170.

As shown best in FIGS. 1 and 5, the attachment strap 110 can be formed into a closed loop used to retain and secure an article, such as the accessory pouch 140, to a belt (e.g., the belt 170 shown in FIG. 5), or other suitably configured interface. A fastener 130 is used to form the attachment strap 110 into a closed loop. The example fastener 130 comprises a threaded post 132 and a screw 134. The attachment strap 110 comprises a top portion 112, a bottom portion 114, and a middle portion 116. Each portion (112, 114, 116) of the attachment strap 110 includes an opening (118, 120, 122) shaped so that the threaded post 132 of the fastener 130 can extend therethrough. In the preferred implementation of the attachment strap 110, each of the openings (118, 120, 122) is circular. The opening 118 of the top portion 112 is located near a first end 124 of the attachment strap 110; the opening 120 of the bottom portion 114 is located near a second end 126 of the attachment strap 110; the opening 122 in the middle portion 116 is offset from a center of the attachment strap 110.

The following steps may be used to form the attachment strap 110 into a closed loop. Initially, fold the bottom portion 114 then the top portion 112 so that their respective openings (118, 120) are aligned with the opening 122 of the middle portion 116. Note, the bottom portion 114 should be positioned between the top portion 112 and the middle portion 116 of the attachment strap 110 (see, e.g., FIG. 1). Then, insert the threaded post 132 of the fastener 130 through the aligned openings (118, 120, 122) of the attachment strap 110. Next, thread the screw 134 into the threaded post 132 of the fastener 130. In this way, the attachment strap 110 is formed into a closed loop. As seen in FIG. 1, a portion of the fastener 130 extends across the opening defined by the closed loop (see, e.g., FIG. 1).

The attachment strap 110 is constructed as one piece, and is fabricated from a polypropylene composite material (e.g., Tegris® brand thermoplastic composite fabric or CURV® brand thermoplastic composite). The attachment strap 110 is preferably made of a 6-layer Tegris® material or a 0.7 mm thick CURV® material. However, other implementations of the attachment strap 110 can be made of a thicker Tegris® material, up to and including a 12-layer Tegris® material, or a thicker CURV® material, up to and including a 1.4 mm thick CURV® material. If the material is any thicker, the attachment strap 110 may be unable to fold. Though the preferred implementations of the attachment strap 110 are made of a Tegris® brand thermoplastic composite fabric or a CURV® brand thermoplastic composite, another suitable material or combination of materials could be used. Each portion (132, 134) of the fastener 130 is fabricated of an aluminum alloy (e.g., a 7075-aluminum alloy), though another suitable material (e.g., a steel alloy) could be used.

As shown best in FIGS. 3 and 5, the mounting plate 142 is secured to the backside of the accessory pouch 140, and can be used in conjunction with the attachment strap 110 to secure the accessory pouch 140 to the belt 170 in three orientations. The mounting plate 142 comprises an array of three slots (144, 146, 148), an array of three triangular openings (150, 152, 154), and an array of three circular openings (156, 158, 160). The array of triangular openings (150, 152, 154) is positioned about the array of circular openings (156, 158, 160); the array of slots (144, 146, 148) is positioned about the array of triangular openings (150, 152, 154). The slots (144, 146, 148), triangular openings (150, 152, 154), and circular openings (156, 158, 160) are positioned to facilitate attaching the mounting plate 142, and thereby the accessory pouch 140, to the belt 170 in three orientations, as will be discussed in greater detail below. In particular, the slots (144, 146, 148), the triangular openings (150, 152, 154), and the circular openings (156, 158, 160) are arranged on the mounting plate 142 such that each slot is linearly aligned with one triangular opening and one circular opening (see, e.g., the linear alignment, indicated by line A in FIG. 3, of slot 146 with triangular opening 152 and circular opening 158).

The mounting plate 142 is constructed as one piece, and is fabricated from a polypropylene composite material (e.g., Tegris® brand thermoplastic composite fabric or CURV® brand thermoplastic composite). In some implementations, the mounting plate 142 is made of a 12-layer Tegris® material or a 1.4 mm thick CURV® material. However, another suitable material or combination of materials could be used.

While the example accessory pouch 140 is configured to receive and retain a pistol magazine (not shown), the accessory pouch 140 disclosed herein is provided as a nonlimiting example only. Accordingly, it should be understood that the mounting plate 142 could be configured for attachment to another accessory pouch, or article, configured to hold an item other than a pistol magazine.

Use of the Multi-Orientation Attachment System

Figure 6:
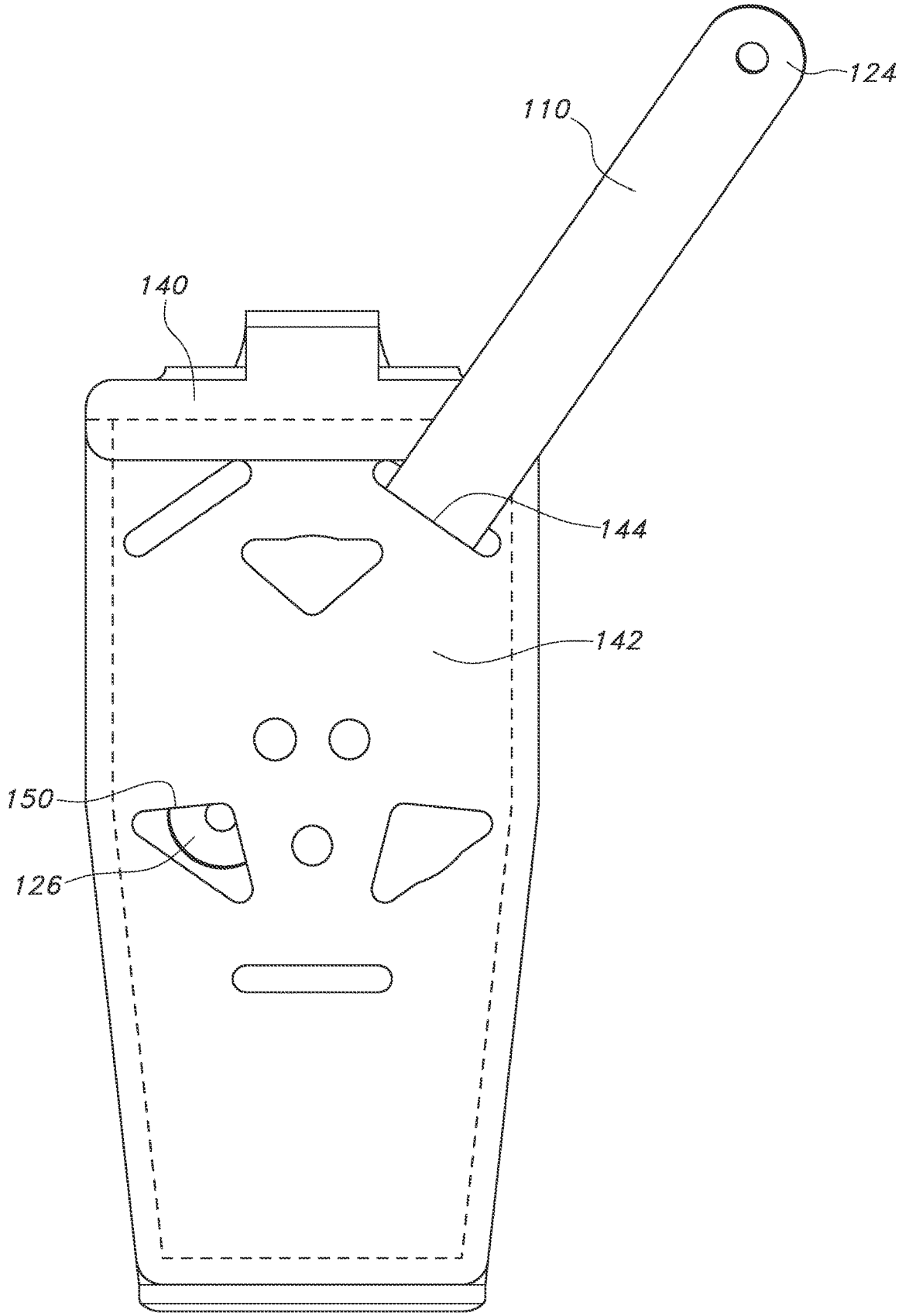
FIGS. 6 through 10 illustrate example steps used to attach the accessory pouch to the belt using the attachment strap and mounting plate.
Figure 7:
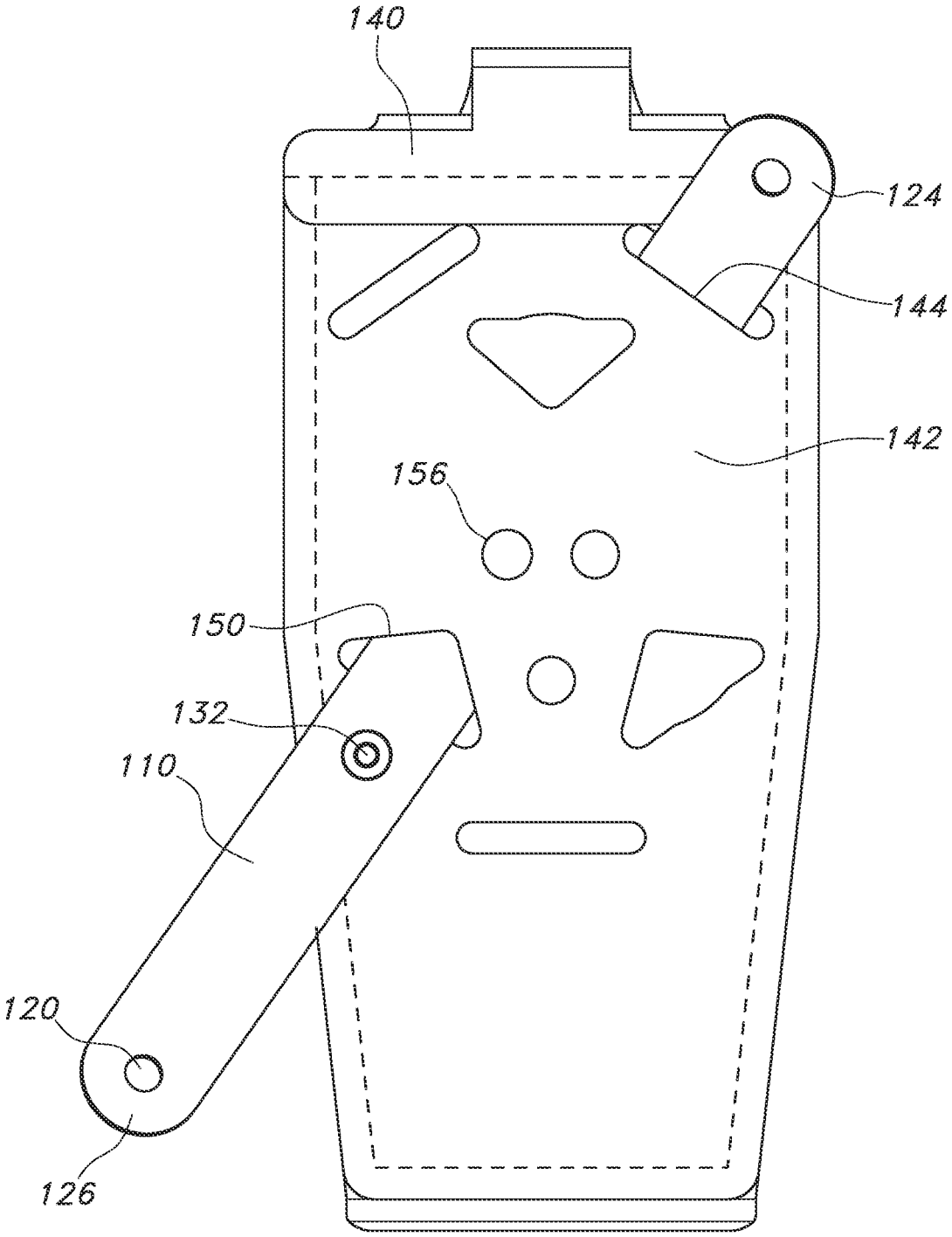
Figure 8:
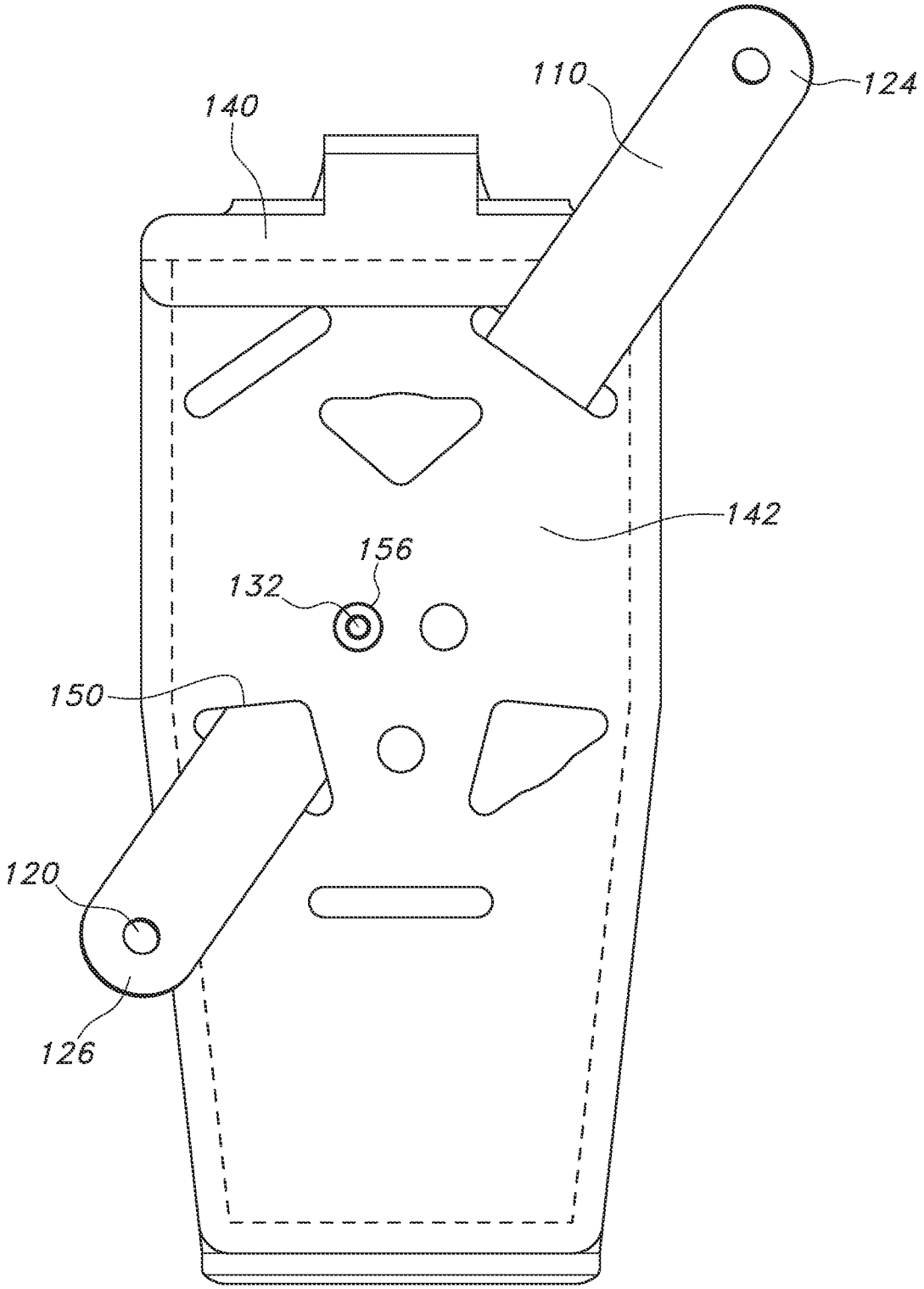
Figure 9:
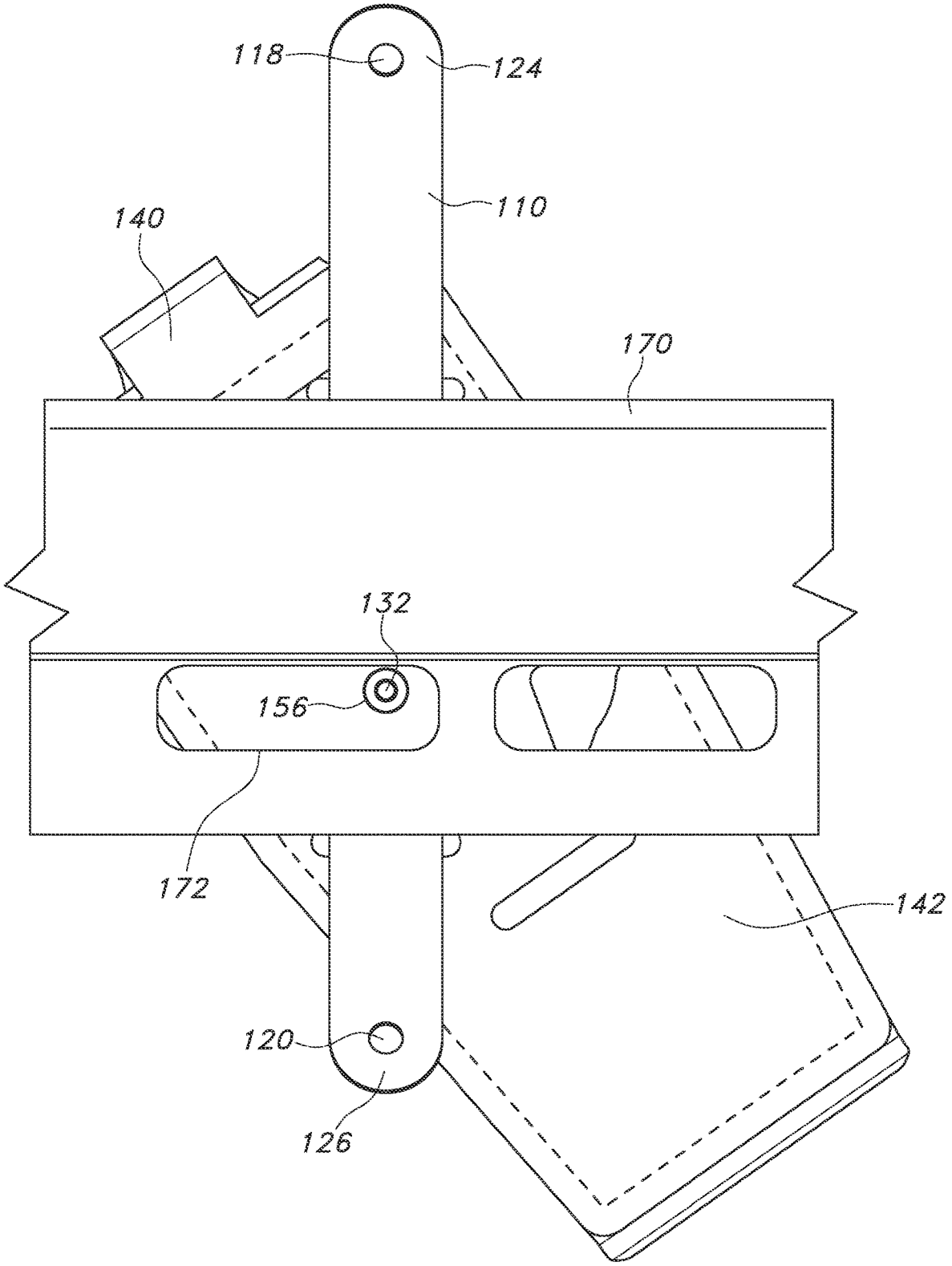
Figure 10:
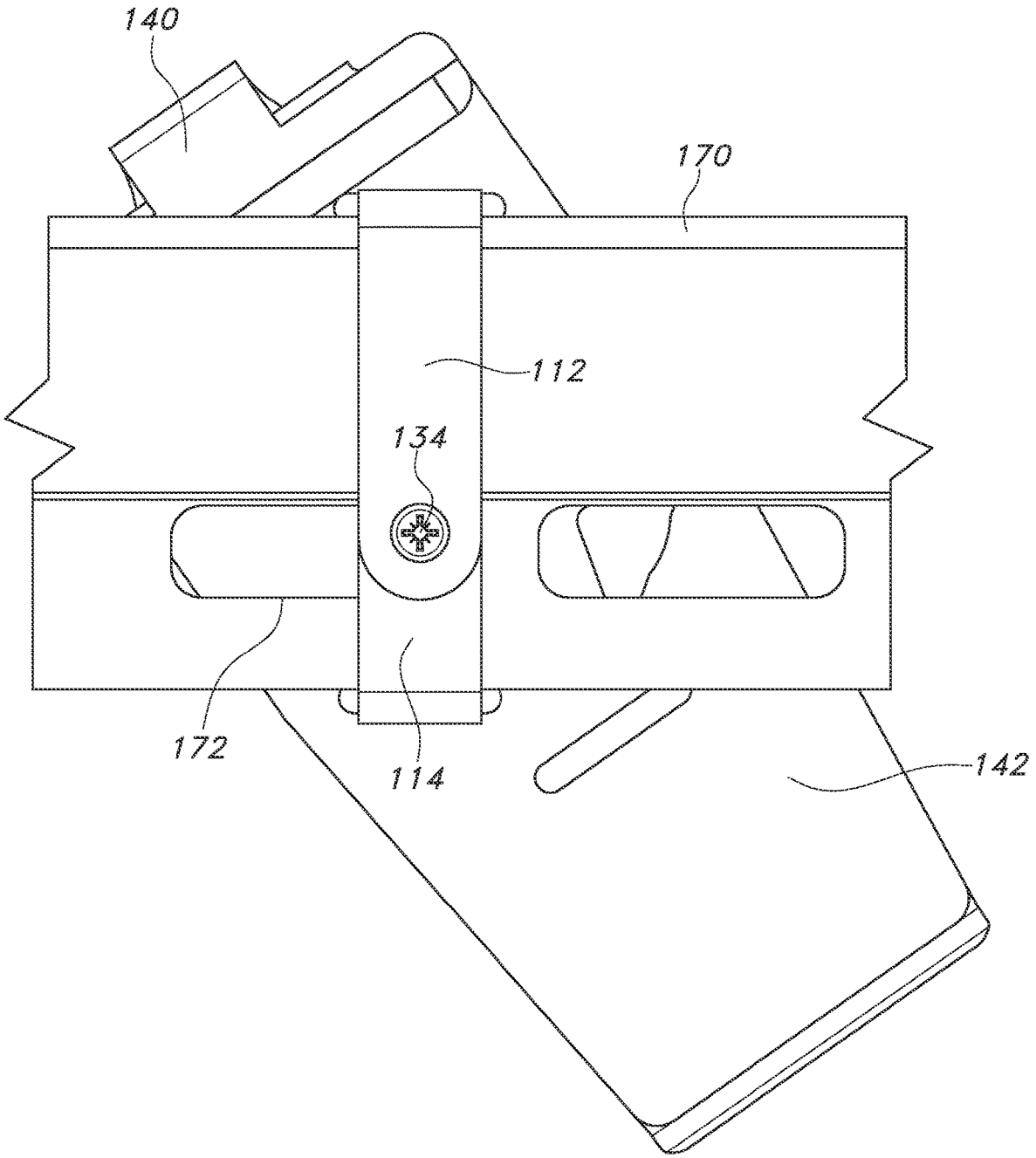

The following steps can be used to attach the accessory pouch 140 to the belt 170. Initially, insert the bottom end 126 of the attachment strap 110 through the first slot 144 of the mounting plate 142 and route the attachment strap 110 through the first triangular opening 150 so that the openings (120, 122) of the bottom portion 114 and middle portion 116 extend from the first triangular opening 150 (see, e.g., FIGS. 6 and 7). Then, insert the threaded post 132 of the fastener 130 into the opening 122 of the middle portion 116 of the attachment strap 110 (see, e.g., FIG. 7). Next, adjust the position of the attachment strap 110 so that the threaded post 132 of the fastener 130 extends through the first circular opening 156 of the mounting plate 142 (see, e.g., FIG. 8). Then, position the mounting plate 142 so that the threaded post 132 of the fastener 130 extends through a desired mounting slot 172 on the belt 170 (see, e.g., FIG. 9). Next, fold the bottom portion 114 of the attachment strap 110 over a bottom edge of the belt 170 and insert the threaded post into the opening 120 of the bottom portion 114. Then, fold the top portion 112 of the attachment strap 110 over a top edge of the belt 170 and insert the threaded post 132 into the opening 118 of the top portion 112. Finally, insert the screw 134 and fasten to the threaded post 132 (see, e.g., FIG. 10).

The above-described steps route the attachment strap 110 through the first slot 144 and triangular opening 150 of the mounting plate 142 and rely on the first circular opening 156 to position the accessory pouch 140 in a first orientation on the belt 170. This first orientation provides for a rearward cant of the accessory pouch 140 when positioned on the left-hand side of a wearer (see, e.g., FIG. 4).

The mounting plate 142 is configured to facilitate mounting the accessory pouch 140 to the belt 170 in two other orientations, for example, a second orientation that provides for a forward cant of the accessory pouch 140 when positioned on the left-hand side of the wearer, and a third orientation that provides for a neutral cant of the accessory pouch 140. The second orientation is achieved by routing the attachment strap 110 through a combination of the second slot 146 and triangular opening 152 of the mounting plate 142 and using the second circular opening 158 to anchor the threaded post 132 in position; the third orientation is achieved by routing the attachment strap 110 through a combination of the third slot 148 and triangular opening 154 of the mounting plate 142 and using the third circular opening 160 to anchor the threaded post 132 in position.

Although not shown in the illustrations, it should be understood that a mounting plate 142 could be configured such that it can only be attached to the belt 170, or other suitably configured interface, in two orientations. Such an implementation of the mounting plate 142 would lack one slot and the triangular opening and circular opening linearly aligned therewith.

The foregoing description of the invention is intended to be illustrative; it is not intended to be exhaustive or to limit the claims to the precise forms disclosed. Those skilled in the relevant art can appreciate that many modifications and variations are possible in light of the foregoing description and associated drawings.

Reference throughout this specification to an "embodiment" or "implementation" or words of similar import means that a particular described feature, structure, or characteristic is included in at least one embodiment of the present invention. Thus, the phrase "in some embodiments" or a phrase of similar import in various places throughout this specification does not necessarily refer to the same embodiment.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown, or in sequential order, or that all illustrated operations be performed, to achieve desirable results.

The invention claimed is:

1. An attachment system configured to retain and secure an article to a belt, the attachment system comprising:

an attachment strap comprising a top portion, a bottom portion, and a middle portion, each of which includes an opening;

a fastener comprising a threaded post and a screw; and a mounting plate secured to a side of the article, the mounting plate comprising a first array of openings, a second array of openings, and a third array of openings;

wherein:

the attachment strap is configured to fold so that the opening in the bottom portion and the opening in the top portion are both aligned with the opening in the middle portion;

the fastener is configured to extend through the aligned openings of the attachment strap and removably fasten both the bottom portion and the top portion to the middle portion to form a closed loop;

the mounting plate is configured to be used in conjunction with the attachment strap to secure the article to the belt in at least one orientation; and the first array of openings, the second array of openings, and the third array of openings are positioned to facilitate attaching the mounting plate, and thereby the article, in more than one orientation on the belt.

2. The attachment system of claim 1, wherein the first array of openings is an array of slots, the second array of openings is an array of triangular openings, and the third array of openings is an array of circular openings.

3. The attachment system of claim 1, wherein the opening in the top portion is located near a first end of the attachment strap, the opening in the bottom portion is located near a second end of the attachment strap, and the opening in the middle portion is offset from a center of the attachment strap.

4. The attachment system of claim 3, wherein the attachment strap is a single unitary piece of flexible thermoplastic composite material.

5. A method of securing an article to a belt, the method comprising:

providing an attachment strap comprising a top portion, a bottom portion, and a middle portion, each of which includes an opening;

providing a fastener comprising a threaded post and a screw;

providing a mounting plate securable to an article, the mounting plate comprising a first slot, a first triangular opening, and a first circular opening, wherein the first slot, the first triangular opening, and the first circular opening are positioned to facilitate using the attachment strap to secure the mounting plate, and thereby the article, to the belt;

inserting a bottom end of the attachment strap through the first slot of the mounting plate and routing the attachment strap through the first triangular opening so that the opening in the top portion and the opening in the bottom portion of the attachment strap extend from the first triangular opening;

inserting the threaded post of the fastener into the opening of the middle portion of the attachment strap;

adjusting the position of the attachment strap so that the threaded post of the fastener extends through the first circular opening of the mounting plate;

positioning the mounting plate so that the threaded post of the fastener extends through a mounting slot in the belt;

folding the bottom portion of the attachment strap over a bottom edge of the belt and inserting the threaded post of the fastener into the opening of the bottom portion;

folding the top portion of the attachment strap over a top edge of the belt and inserting the threaded post of the fastener into the opening of the top portion; and threading the screw into the threaded post of the fastener.

6. The method of claim 5, wherein the mounting plate comprises an array of slots, an array of triangular openings, and an array of circular openings, wherein the array of slots, the array of triangular openings, and the array of circular openings are positioned to facilitate attaching the mounting plate, and thereby the article, in more than one orientation on the belt.

* * * * *